US007182660B2

(12) United States Patent
De Baan

(10) Patent No.: US 7,182,660 B2
(45) Date of Patent: Feb. 27, 2007

(54) OFFSHORE FLUID TRANSFER SYSTEM

(75) Inventor: Jacob De Baan, Maassluis (NL)

(73) Assignee: Bluewater Energy Services BV (NL)

( * ) Notice: Subject to any disclaimer, the term of this patent is extended or adjusted under 35 U.S.C. 154(b) by 0 days.

(21) Appl. No.: 10/490,087

(22) PCT Filed: Sep. 24, 2001

(86) PCT No.: PCT/IB01/02228

§ 371 (c)(1),
(2), (4) Date: Oct. 14, 2004

(87) PCT Pub. No.: WO03/026952

PCT Pub. Date: Apr. 3, 2003

(65) Prior Publication Data

US 2005/0047873 A1 Mar. 3, 2005

(51) Int. Cl.
*B63B 27/24* (2006.01)

(52) U.S. Cl. ..... 441/5; 441/4; 114/230.1

(58) Field of Classification Search ..... 441/3–5; 114/230.1, 230.12, 263; 405/158, 169
See application file for complete search history.

(56) References Cited

U.S. PATENT DOCUMENTS 3,841,501 A 10/1974 Van Heijst
6,701,981 B1 * 3/2004 Olsen ..... 141/388

FOREIGN PATENT DOCUMENTS

| | | |
|---|---|---|
| FR | 1.421.700 | 12/1964 |
| GB | 2056391 | 3/1981 |
| GB | 2191462 | * 12/1987 |
| GB | 2328196 | * 2/1999 |

* cited by examiner

*Primary Examiner*—Sunil Singh
(74) *Attorney, Agent, or Firm*—Fulwider Patton, LLP

(57) ABSTRACT

Apparatus for transferring fluid between first and second floating vessels is described, comprising a submerged rigid transfer arm defining a fluid conduit for receiving fluid from a first vessel, a first end of the arm attached to the first floating vessel so as to allow the arm to pivot about at least two axes, and loading apparatus located at the second end of the arm and attachable to the second floating vessel for transferring fluid from the fluid conduit to the floating vessel. The apparatus is provided with draught regulating means operable to increase and decrease the draught of at least a part of the apparatus, and a support structure, such as an outrigger arm with a fender system projecting from the rigid arm and adapted to brace the apparatus against the second floating vessel.

19 Claims, 3 Drawing Sheets

OFFSHORE FLUID TRANSFER SYSTEM

The present invention relates to apparatus for transferring fluid between two structures, for example two floating vessels, or a fixed offshore structure and a vessel.

Transferring fluid, particularly of a cryogenic product, between two floating vessels, or a fixed offshore structure and a vessel, is a difficult and hazardous operation when performed in open sea. Various systems for transferring fluid have been proposed. For example, UK patent 2328196 describes a system which employs a rigid arm, one end of which is fixed in an articulated fashion to a storage vessel. The other end is supported by means of a flotation tank. A receiving vessel can be moored to this end of the rigid arm to receive fluid transferred from the storage vessel. The fluid transfer system between the rigid arm and the receiving vessel may be handled by articulated rigid pipes, for example of the type described in U.S. Pat. No. 3,556,148.

One disadvantage of such a system is that a relatively high vertical motion differential may occur between the rigid transfer arm and the recipient vessel, especially if wave frequency levels are such as to make it difficult for the articulated rigid pipes to follow the motion due to the large inertia of such pipes. Therefore, there is a need to improve the relative motion behaviour between the rigid arm and the recipient vessel.

Accordingly, the present invention provides apparatus for transferring fluid between a first structure and a floating vessel, comprising a submerged rigid transfer arm defining a fluid conduit for receiving fluid from a first structure, means to attach a first end of the arm to the first structure so as to allow the arm to pivot about at least two axes, loading means located at the second end of the arm and attachable to a floating vessel for transferring fluid from the fluid conduit to the floating vessel, wherein the apparatus is provided with draught regulating means operable to increase and decrease the draught of at least a part of the apparatus, and a support structure projecting from the rigid arm and adapted to brace the apparatus against the floating vessel.

Preferably, the draught regulating means comprises at least one tank adapted to be ballasted and emptied to increase and decrease respectively the draught of at least part of the apparatus.

Conveniently, the draught regulating means is mounted at the second end of the rigid arm.

Preferably, the rigid arm pivots about a substantially horizontal axis at the first end when the draught regulating means is operated.

In a preferred embodiment, the support structure comprises a submerged arm projecting from one side of the rigid arm in the vicinity of its second end and includes a fender system projecting upwardly from the support structure in order to contact the underside of the floating vessel in use.

The support structure may be pivotally attached to the rigid arm for rotation about a substantially vertical axis in use.

The fender system preferably includes at least one resilient body for contacting the vessel.

Alternatively, the fender system may include at least one suction cup for contacting the vessel.

The apparatus may further comprise means to allow relative movement between the fender system and the support structure.

For example, the fender system may be mounted on a platform which is pivotally attached to the support structure for rotation about a substantially vertical axis Alternatively, the fender system may be mounted on a platform which is attached to the support structure by a sliding joint allowing relative movement in a substantially horizontal plane in use.

In an alternative embodiment, the support structure projects upwardly from the rigid arm above the surface of the water in use and a tensioned leg is securable between the support structure and the floating vessel.

Preferably, the apparatus is further provided with thrust means operable to rotate the rigid arm relative to the first structure about a substantially vertical axis in use.

Advantageously, the rigid arm is a space frame construction having a plurality of longitudinal members joined by a plurality of transverse bracing members.

The fluid conduit may be located inside at least one of the longitudinal members.

Insulation is preferably provided around the fluid conduit.

The fluid conduit is preferably provided with flexible connections allowing it to bridge the pivot points in the apparatus.

The loading means may comprise a cryogenic loading device.

The invention also provides a method of transferring fluid from a first structure to a floating vessel using the apparatus described above, comprising the steps of:

operating the draught regulating means to increase the draught of at least part of the rigid arm, moving the vessel into a position in the vicinity of the apparatus, operating the draught regulating means to decrease the draught of at least part of the rigid arm so as to bring the support structure into bracing contact with the vessel, connecting the loading means to the vessel, transferring fluid from the fluid conduit into the vessel, disconnecting the loading means from the vessel, and operating the draught regulating means to increase the draught of at least part of the rigid arm to take the support structure out of contact with the vessel.

The invention will now be described in detail, by way of example of only, with reference to the accompanying drawings in which.

Figures 1, 2:
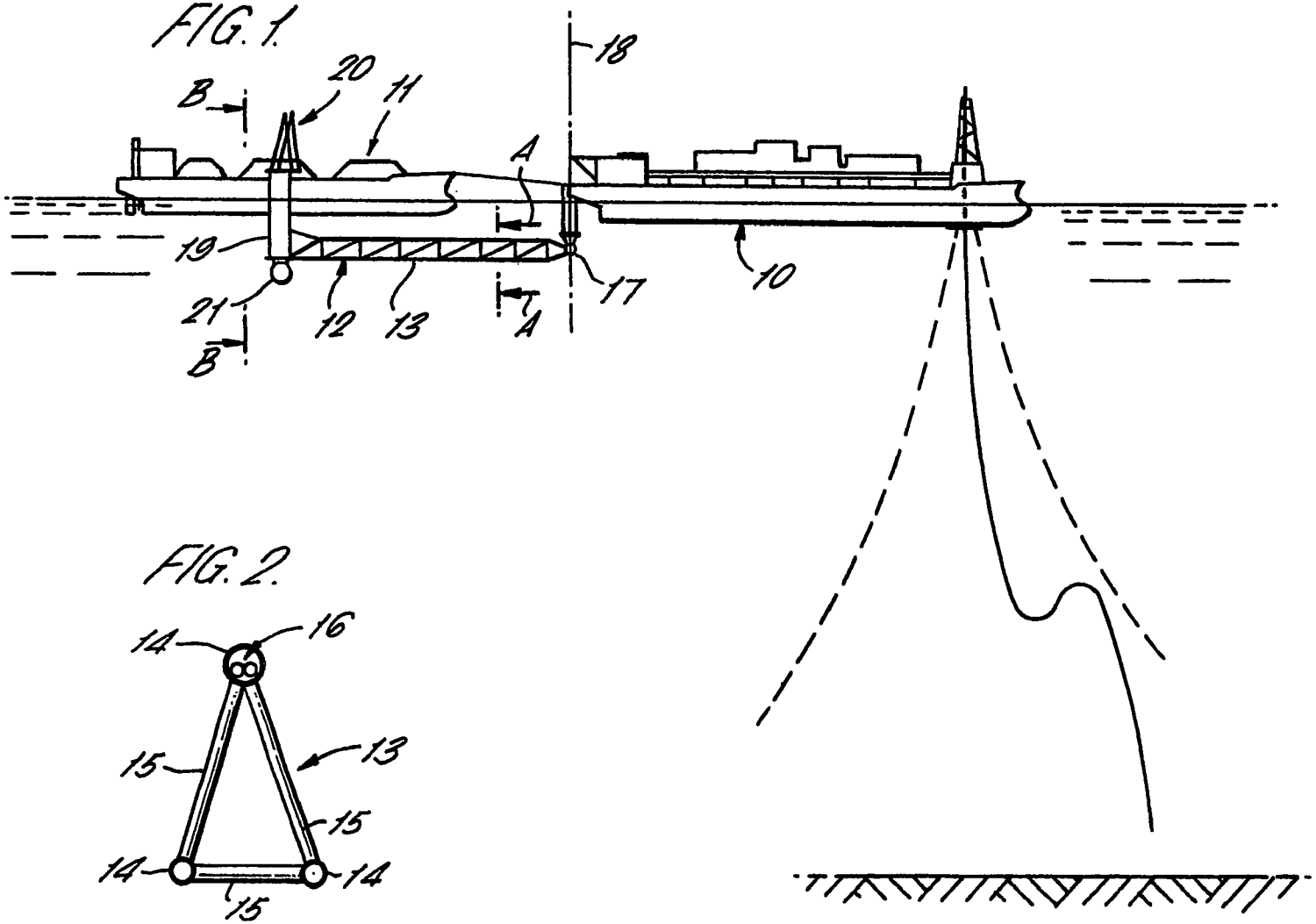
FIG. 1 is a schematic diagram of an apparatus for transferring fluid between two floating vessels in accordance with one embodiment of the invention.
FIG. 2 is a cross section of the rigid arm shown in FIG. 1 along the line A—A.

Referring now to FIG. 1, a first floating vessel 10 is shown, which may be a production or storage vessel moored to the seabed by any conventional and appropriate means. A second floating vessel 11, which may be a shuttle tanker for transporting fluid such as liquid natural gas away from the production/storage vessel 10, is located nearby. The transfer apparatus 12 is shown in use, connecting the two vessels 10, 11.

The transfer apparatus 12 consists of a rigid arm 13, typically of space frame type construction. As shown in FIG. 2, the arm 13 may be formed of three longitudinal members 14 arranged in a triangular form and joined by a number of transverse bracing members 15.

Piping 16, for example rigid steel piping, is attached to the arm and carries the fluid being transferred. The piping 16 may be located inside one or more of the longitudinal members 14 and insulation (not shown) may also be provided. This construction protects the piping 16 but also allows the possibility of inspection of the piping 16.

At a first end of the arm 13, attachment means 17 is provided for attaching the arm 13 to the first vessel 10. The attachment means may be constructed in any convenient form which includes articulations allowing the arm 13 to pivot about at least two axes relative to the vessel 10, preferably the vertical axis 18 and the horizontal axis extending into and out of the plane of the paper. The attachment means is sized such that the arm 13 is located underwater at a depth greater than the maximum draught of both the first and second vessels 10, 11.

At the second end of the arm 13, float means 19 is provided which extends upwardly from the arm 13 and projects above the water surface.

A loading device 20, which is preferably a cryogenic loading device of known form, is located on the top of the float means 19. Articulations may be provided to allow the loading device 20 to pivot relative to the float means 19. The loading device is connected to the piping 16 and is connectable to the second vessel 11 to allow transfer of fluid from the piping 16 to the vessel 11. Preferably the loading device 20 is configured to allow fluid pumped from the first vessel 10 to be readily returned to it, for example in the case of an emergency disconnect from the second vessel 11.

The piping 16 is preferably provided with flexible connections such as swivel joints or flexible hoses where necessary to allow it to bridge the various points of articulation in the apparatus 12.

The rigid arm 13 is preferably designed to be of a suitable length such that in use its second end will be adjacent a midship portion of the second vessel 11.

Preferably, at the lower end of the float member 19, one or more thrusters 21 is located. The thruster 21 is powered and controlled from the first vessel 10, for the purpose described further below.

Figure 3:
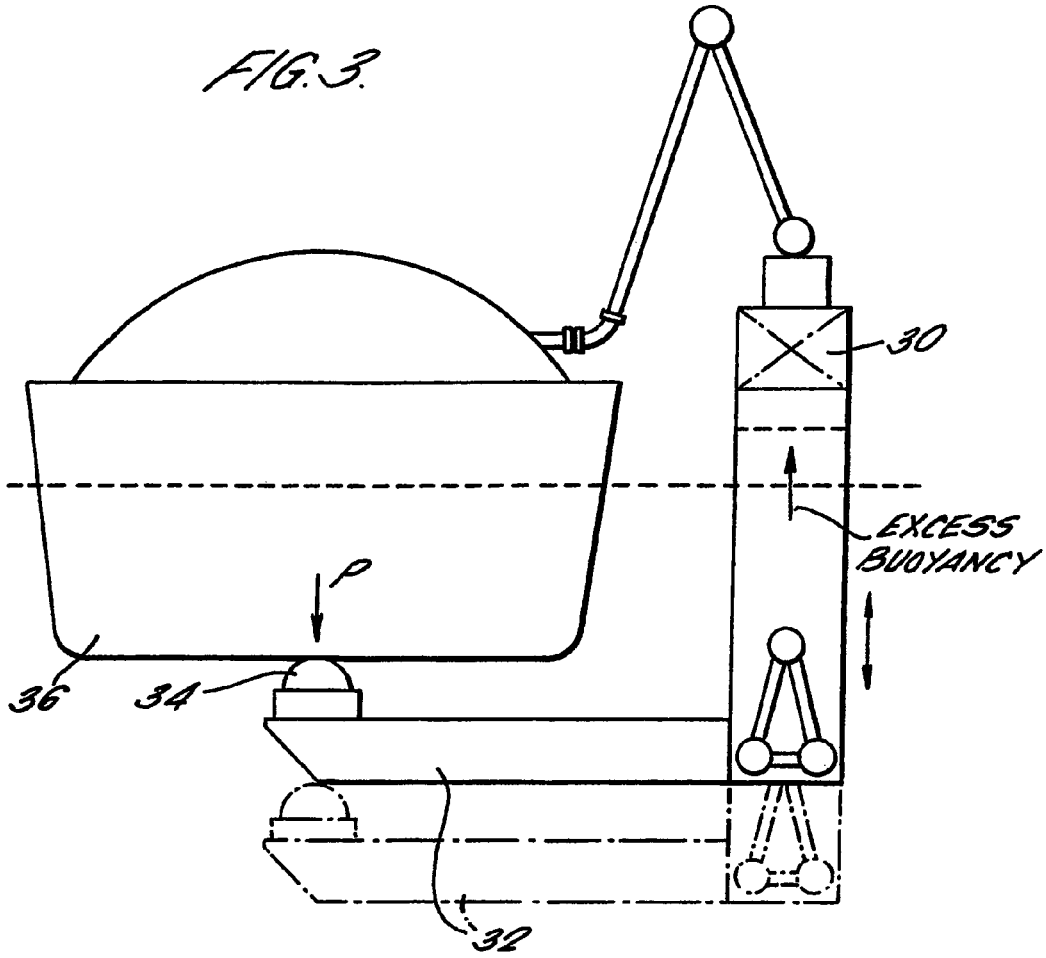
FIG. 3 is a cross section of the apparatus shown in FIG. 1 along the line B—B.

In accordance with one embodiment of the present invention, the float means 19 at the end of the rigid arm 13 is also equipped with means to regulate the draught of at least part of the transfer apparatus 12, in the form of at least one ballast tank 30. When there is no fluid transfer taking place, the tank 30 is ballasted, for example with seawater, to further submerge the rigid arm 13 such that the natural draught position is as shown by the dotted lines in FIG. 3. This is at a depth a few metres below the underside of the hull 36 of the receiving vessel 11.

It will be appreciated that any other means of regulating the draught of the float means 19 may be employed.

The attachment means 17 may allow the rigid arm 13 to pivot about a substantially horizontal axis in use, so that when the tank 30 is ballasted, the rigid arm 13 pivots and it is the second end of the rigid arm 13 which is submerged to a greater extent. Alternatively, the entire rigid arm 13 may remain substantially horizontal and be submerged to a greater extent by ballasting of the tank 30. In this case, the attachment means 17 is able to accommodate this vertical movement of the rigid arm 13.

The transfer apparatus 12 is also fitted with a support structure which is used to brace the apparatus against the vessel 11. In a preferred embodiment this rakes the form of a rigid outrigger arm 32 which extends from the second end of the rigid arm 13 at approximately 90° towards the side at which the vessel 11 is to be located. Preferably, the outrigger 32 is long enough to extend to the midship position beneath the hull of the vessel 11 in use. A resilient fender system 34 is fitted at the far end of the outrigger 32, projecting upwardly. Once the ballast tank 30 of the float means 19 is emptied, the transfer apparatus 12 rises in the water until the fender system 34 contacts the hull 36 of the vessel 11 to brace the apparatus 12 against the vessel 11.

The transfer apparatus 12 is designed such that when the fender system 34 contacts the hull 36 of the vessel 11, the transfer apparatus 12 still has some excess buoyancy, causing the fender system 34 to exert an upward force on the vessel 11. This in turn creates a reaction force P by the hull 36 of the vessel 11 against the fender system 34, outrigger 32 and rigid arm 13, preferably in the order of 100–200 metric tons. This has the effect of fully suppressing the vertical motion of the transfer apparatus 12 with respect to the vessel 11 and both move up and down with the waves as one body. Thus, the dynamic and relative motion effects on the articulated rigid transfer apparatus 12 is now minimised. This enhances the safety and service life of the apparatus and offers the possibility of using standard marine loading arms as well known in the art.

The fender system 34 may comprise one or more resilient bodies, eg made from rubber. Alternatively, it may take the form of one or more suction cups (not shown) which grip the hull 36 by suction.

When the transfer apparatus 12 is not being used, the tank 30 may remain ballasted so that the rigid arm 13 is deeply submerged. When transfer of fluid to a second vessel 11 is required, the thruster(s) 21 can be used to rotate the arm 13 about the vertical axis 18, for example to rotate it anticlockwise if viewed from above in FIG. 1, so that it does not obstruct the area around the stern of the first vessel 10. The second vessel 11 can then be manoeuvred into position adjacent the first vessel 10 as shown in FIG. 1.

Once the second vessel 11 is in position the thruster(s) 21 can be operated again to rotate the arm 13 in the opposite direction to bring the float means 19 and loading device 20 adjacent preferably the midship portion of the second vessel 11. The tank 30 can be emptied to raise the rigid arm 13 and the outrigger 32 to bring the fender system 34 into contact with the hull 36 of the vessel 11. The loading device 20 is moored to the vessel 11 and fluid from the piping 16 can be transferred to the second vessel 11. When transfer is complete, the loading device 20 is disconnected from the vessel 11, the tank 30 ballasted to lower the outrigger 32 and thus separate the fender system 34 from the hull. The thruster(s) 21 can then be operated to rotate the arm 13 away from the vessel 11.

Alternatively, when not in use the tank 30 may be empty and only ballasted when desired, for example when the transfer operation described above is about to begin.

If thrusters are not employed, the draught regulating means can simply be used to deeply submerge the rigid arm 13 and the outrigger arm 32 to keep them out of the way of the approaching vessel 11.

Figure 4:
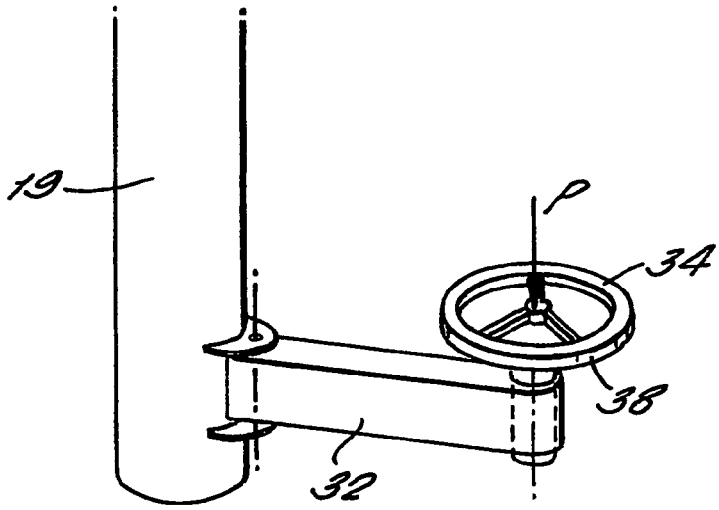
FIG. 4 shows a further embodiment of the fender system shown in FIG. 3.

A further enhancement of the system of the present invention is shown in FIG. 4. In this case, the outrigger arm 32 is pivotally attached to the rigid arm 13, for rotation about a substantially vertical axis. Also, the fender system 34 is mounted on a platform 38 which is pivotally attached to the outrigger arm 32, for rotation about a substantially vertical axis. Once the fender system 34 is pressed against the hull 36, these pivots will accommodate some movement of the vessel 11 relative to the rigid arm 13 in a nominally horizontal plane, for example as the result of surge motions between the two vessels 10, 11.

Figure 5:
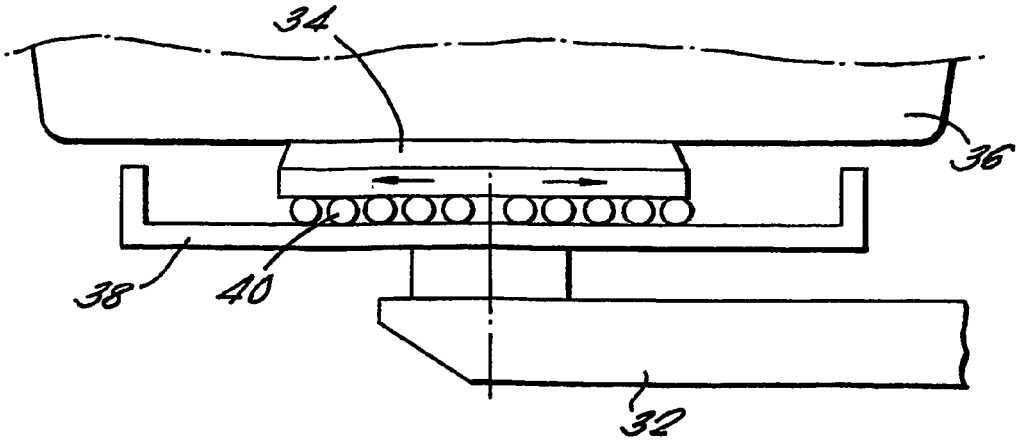
FIG. 5 shows another embodiment of the fender system shown in FIG. 3.

In addition to or instead of these pivots, sliding means 40 such as a roller joint may be introduced between the platform 38 which carries the fender system 34 and the outrigger arm 32 which allows relative sliding movement therebetween, as shown in FIG. 5. This effectively prevents sliding occurring between the hull 36 and the fender system 34. This prevents the fender system 34 being dragged across the hull 36, which may result in damage to the paint system of the vessel 11.

Figure 6:
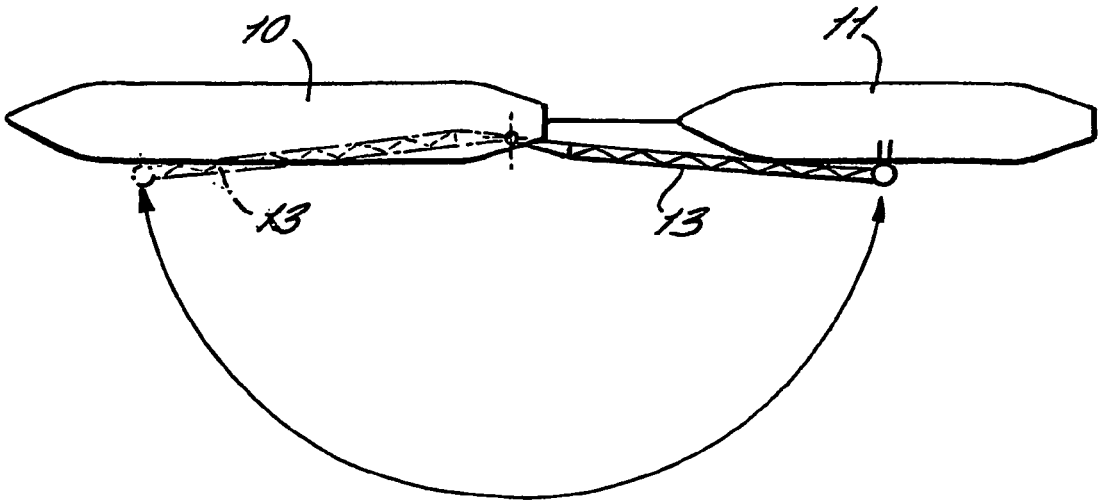
FIG. 6 shows the apparatus from above in use (in solid lines) and when not in use (in dotted lines).

When the transfer apparatus 12 is not being used, it may have its second end secured to the first vessel 10. For example, if the rigid arm is attached to the stern of the vessel 10, it can be pivoted back round so that its second end can be secured to the vessel 10 towards the bow region as shown in dotted lines in FIG. 6. In this way the transfer apparatus 12 is able to withstand extreme weather conditions which may exceed its design parameters. It also allows inspection, repair and maintenance to be carried out more easily.

Although the invention has been described with reference to transferring fluid between two floating vessels it will be appreciated that it is also applicable to transfer between a fixed structure and a vessel.

Other modifications and variations to the invention are also possible. For example, instead of a submerged outrigger and fender system, the rigid arm 13 could be braced against the vessel 11 by using a structure which projects upwardly from the rigid arm 13 above the surface of the water and a tensioned leg which is secured between the structure and a strong point on the deck of the vessel 11. Articulations may be provided at the ends of the tensioned leg.

The invention claimed is:

1. Apparatus for transferring fluid between first and second floating vessels, comprising a submerged rigid transfer arm defining a fluid conduit for receiving fluid from the first vessel, means to attach a first end of the arm to the first vessel so as to allow the arm to pivot about at least two axes, loading means located at the second end of the arm and attachable to the second floating vessel for transferring fluid from the fluid conduit to the second floating vessel, wherein the apparatus is provided with draught regulating means operable to increase and decrease the draught of at least a part of the apparatus, and a support structure projecting from the rigid arm and adapted to brace the apparatus against the second vessel, and wherein the draught regulating means is adapted to decrease the draught to such extent that the support structure is brought into contact with the second vessel due to a relative buoyancy difference between the support structure and the second vessel, such that said buoyancy difference acts with sufficient force to suppress relative vertical motion between the arm and the second vessel.

2. Apparatus as claimed in claim 1, wherein the draught regulating means comprises at least one tank adapted to be ballasted and emptied to increase and decrease respectively the draught of at least part of the apparatus.

3. Apparatus as claimed in claim 1, wherein the draught regulating means is mounted at the second end of the arm.

4. Apparatus as claimed in claim 1, wherein the rigid arm pivots about a substantially horizontal axis at the first end when the draught regulating means is operated.

5. Apparatus as claimed in claim 1, wherein the support structure comprises a submerged arm projecting from one side of the rigid arm in the vicinity of its second end and includes a fender system projecting upwardly from the support structure in order to contact the underside of the second floating vessel in use.

6. Apparatus as claimed in claim 5, wherein the fender system includes at least one resilient body for contacting the second vessel.

7. Apparatus as claimed in claim 5, wherein the fender system includes at least one suction cup for contacting the second vessel.

8. Apparatus as claimed in claim 5, further comprising means to allow relative movement between the fender system and the support structure.

9. Apparatus as claimed in claim 8, wherein the fender system is mounted on a platform which is pivotally attached to the support structure for rotation about a substantially vertical axis.

10. Apparatus as claimed in claim 8, wherein the fender system is mounted on a platform which is attached to the support structure by a sliding joint allowing relative movement in a substantially horizontal plane in use.

11. Apparatus as claimed in claim 1, wherein the support structure is pivotally attached to the rigid arm for rotation about a substantially vertical axis in use.

12. Apparatus as claimed in claim 1, wherein the support structure projects upwardly from the rigid arm above the surface of the water in use and a tensioned leg is securable between the support structure and the second vessel.

13. Apparatus as claimed in claim 1, wherein the apparatus is further provided with thrust means operable to rotate the rigid arm relative to the first vessel about a substantially vertical axis in use.

14. Apparatus as claimed in claim 1, wherein the rigid arm is a space frame construction having a plurality of longitudinal members joined by a plurality of transverse bracing members.

15. Apparatus as claimed in claim 14, wherein the fluid conduit is located inside at least one of the longitudinal members.

16. Apparatus as claimed in claim 15, wherein insulation is provided around the fluid conduit.

17. Apparatus as claimed in claim 1, wherein the fluid conduit is provided with flexible connections allowing it to bridge the pivot points in the apparatus.

18. Apparatus as claimed in claim 1, wherein the loading means comprises a cryogenic loading device.

19. A method of transferring fluid from a first to a second floating vessel using the apparatus as claimed in claim 1, comprising the steps of: operating the draught regulating means to increase the draught of at least part of the rigid arm, moving the second vessel into a position in the vicinity of the apparatus, operating the draught regulating means to decrease the draught of at least part of the rigid arm so as to bring the support structure into bracing contact with the second vessel, and wherein the draught regulating means is adapted to decrease the draught to such extent that the support structure is brought into contact with the second vessel due to a relative buoyancy difference between the support structure and the second vessel, such that said buoyancy difference acts with sufficient force to suppress relative vertical motion between the arm and the second vessel, connecting the loading means to the second vessel, transferring fluid from the fluid conduit into the second vessel, disconnecting the loading means from the second vessel, and operating the draught regulating means to increase the draught of at least part of the rigid arm to take the support structure out of contact with the second vessel.

* * * * *